US007219868B2

(12) United States Patent
Marler et al.

(10) Patent No.: US 7,219,868 B2
(45) Date of Patent: May 22, 2007

(54) HOOK DEVICE FOR ATTACHMENT TO TABLES AND THE LIKE

(75) Inventors: Rebecca L Marler, Marion, IN (US); Jon R Marler, Marion, IN (US)

(73) Assignee: REC Enterprises, Ltd, Fort Wayne, IN (US)

( * ) Notice: Subject to any disclaimer, the term of this patent is extended or adjusted under 35 U.S.C. 154(b) by 17 days.

(21) Appl. No.: 10/939,927

(22) Filed: Sep. 13, 2004

(65) Prior Publication Data

US 2006/0054761 A1 Mar. 16, 2006

(51) Int. Cl.
*F16B 45/00* (2006.01)

(52) U.S. Cl. ..... 248/304; 248/306; 248/308; 248/339; 248/341; 248/904; 248/914; 248/499; 16/438; 16/429; 16/256; 16/258; 16/268; 16/269; 16/285

(58) Field of Classification Search ..... 248/304, 248/306, 308, 339, 341, 904, 914, 499; 16/438, 16/429, 256, 258, 268, 269, 285, 286
See application file for complete search history.

(56) References Cited

U.S. PATENT DOCUMENTS 765,372 A * 7/1904 Bading ..... 16/285
1,376,546 A * 5/1921 Jeep ..... 248/304
2,154,161 A * 4/1939 Heckman ..... 248/308
3,386,589 A * 6/1968 Prete, Jr. ..... 211/118
3,861,633 A * 1/1975 Rappleye et al. ..... 248/290.1
4,081,166 A * 3/1978 Lippert ..... 248/306
4,312,455 A 1/1982 Weber ..... 211/86
5,094,417 A * 3/1992 Creed ..... 248/215
5,433,413 A * 7/1995 Adams ..... 248/205.3
5,664,754 A * 9/1997 Gaenslen ..... 248/317
6,095,469 A * 8/2000 Von Alman ..... 248/304
6,109,579 A * 8/2000 Huang ..... 248/294.1
6,152,419 A 11/2000 Bender ..... 248/551
6,345,796 B1 2/2002 Neuman ..... 248/308
6,467,130 B2 * 10/2002 Kurachi et al. ..... 16/438
6,823,999 B2 * 11/2004 Heneveld, Sr. ..... 211/87.01

* cited by examiner

*Primary Examiner*—Carl D. Friedman
*Assistant Examiner*—Todd M. Epps
(74) *Attorney, Agent, or Firm*—Baker & Daniels LLP

(57) ABSTRACT

A hook device for securement to the substantially horizontal, bottom surface of a table top, bar top, or the like for supporting personal items. The hook device includes a base, a hook, and an attachment mechanism pivotally securing the hook to the base. The attachment mechanism includes a torsion spring that biases the hook into a stored position in which the hook is substantially parallel to the bottom surface of the table top. To use the hook, the hook is pivoted away from the table surface and a personal item, such as a purse, handbag, backpack, coat, or the like is placed on the hook. Once the personal item is removed, the hook returns to its stored position.

17 Claims, 3 Drawing Sheets

HOOK DEVICE FOR ATTACHMENT TO TABLES AND THE LIKE

BACKGROUND OF THE INVENTION

1. Field of the Invention

The present invention relates to a hook device that is mounted to a flat surface, e.g., the bottom of a table or bar top, and is used for suspending personal items therefrom.

2. Description of the Related Art

Hook type supporting devices are used in a variety of environments for supporting personal items including purses, handbags, backpacks, coats, umbrellas, or the like. The hook devices may be permanently or removably mounted to walls, tables, and bar tops, for example. Hook devices eliminate having personal items located on the floor or on the back of a chair where they may be soiled, damaged, forgotten, misplaced, or perhaps stolen. Further, hook devices eliminate the need to uncomfortably hold an item, such as a purse, in a person's lap.

Such devices generally include a base which is secured to the mounting surface and a hook which protrudes from the base. In some embodiments of hook devices, the hook is provided with means for allowing the hook to swivel. The hook is radially moveable through 180 degrees such that the hook may be moved out of the way when not in use.

A problem with such prior art hook devices which protrude from the flat surface of a table is that the device congests space for persons sitting at the table. Even with a pivotable hook, when the hook is not in use, the hook protrudes from the bottom of the table top. A person may contact the hook when sitting at the table making the location of the hook a hindrance, even when the hook is not in use, with potentially undesirable consequences.

In another prior art embodiment of a hook device for supporting personal items, the device may be mounted in a substantially vertical orientation to a shopping cart. The hook device includes a hook which is pivotable between an unused position, wherein the hook is substantially parallel to the shopping cart, and a useable position, wherein the hook protrudes from the cart.

One problem with this particular prior art hook device is that the personal item is in the way of the person pushing the shopping cart, particularly if the personal item, i.e. a purse, begins swaying as movement of the cart is started and stopped. The shopper pushing the cart could repeatedly walk into or be hit by the personal item. Additionally, as the shopper walks away from the cart to look at grocery items, for example, the shopper may come in contact with the hook, catching clothing on the hook protruding from the shopping cart.

It is desired to provide a hook device which has an automatic retractable position to eliminate the possibility of customer contact particularly when the hook is not in use.

SUMMARY OF THE INVENTION

The present invention relates to a hook device for securement to a substantially flat, bottom surface of a table top, bar top, work station, desk, counter, stadium seat, or the like to support personal items. The hook device may also be mounted to the side of a surface such as on gaming machines, or the like, for storage and security of a personal item. The hook device includes a base, a hook, and an attachment mechanism pivotally securing the hook to the base. The attachment mechanism includes a plate and a torsion spring. The torsion spring biases the hook into a stored position in which the hook is substantially parallel to the bottom surface of the table top having no sharp edges protruding therefrom. To use the hook, the hook is pivoted away from the surface and a personal item, such as a purse, handbag, backpack, coat, or the like is suspended from the hook which keeps the hook in its pivoted position. The personal item is then conveniently stored while a person is seated.

The present invention comprises, in one form thereof, a hook device for suspending personal items from a flat surface, including a substantially planar base for attachment to a flat surface. A hook is pivotably mounted to the base, whereby when the hook is in a stored position, the hook is substantially parallel to the flat surface.

The present invention comprises, in another form thereof, in combination, a hook device for suspending personal items and a bottom surface of a table, including a base for attachment to the bottom surface. A table top is provided including a substantially horizontal bottom surface. A hook is provided having a storage position and a use position. A spring is operably mounted with the hook. A mounting plate is secured to the hook and the base, whereby when the hook is in a stored position, the hook is substantially parallel to the bottom surface and when the hook is in a use position the hook is oriented at an angle with respect to the bottom surface. The spring biases the hook into the parallel position.

An advantage of the present invention is that when the hook device is not in use, the hook is substantially parallel to the substantially horizontal table surface.

A further advantage of the present invention is that a torsion spring is used to maintain the stored position of the hook when not in use as well as return the hook to its stored position when the personal item is removed from the hook.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
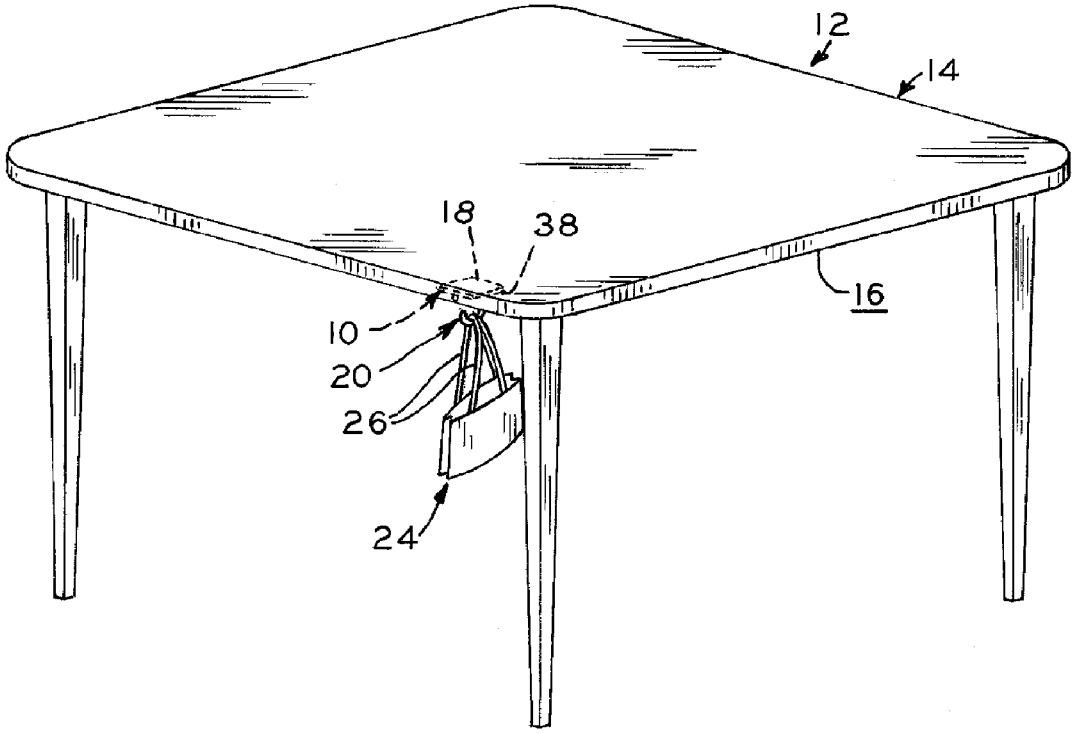
FIG. 1 is a perspective view of a table having a hook device of the present invention mounted to the bottom surface of the table top with a personal item suspended from the hook device.

Corresponding reference characters indicate corresponding parts throughout the several views. Although the exemplification set out herein illustrates several embodiments of the invention, in one form, the embodiments disclosed below are not intended to be exhaustive or to be construed as limiting the scope of the invention to the precise forms disclosed.

DESCRIPTION OF THE PRESENT INVENTION

Figure 2:
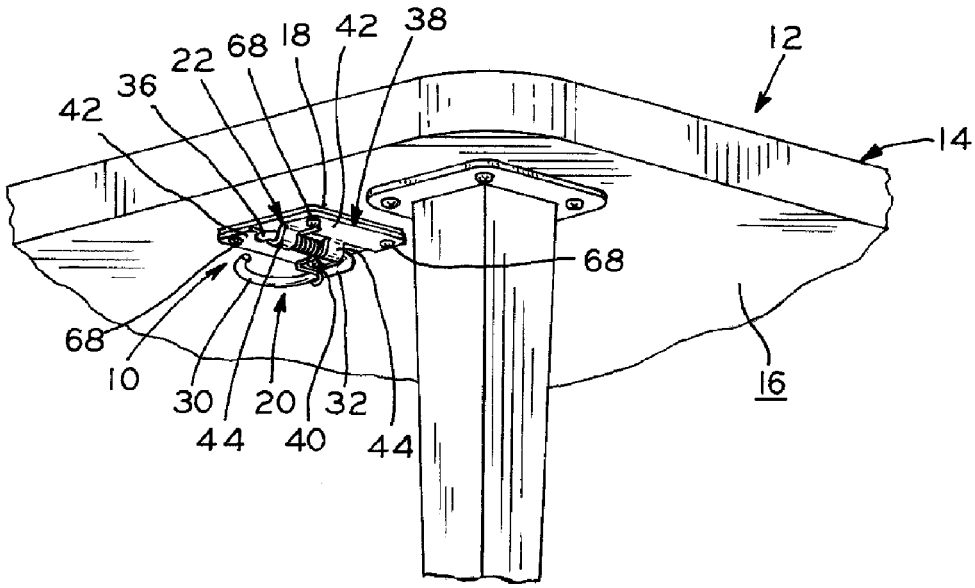
FIG. 2 is a fragmentary perspective view of the table of FIG. 1 illustrating the bottom of the table top and the hook device in a stored position.

Referring to FIGS. 1 and 2, hook device 10 of the present invention is a modular unit which is constructed to be mounted to a substantially flat, bottom surface of a table, bar top, or the like. Hook device 10 is used to support personal items such as a purse, handbag, backpack, coat, or umbrella, for example. The use of hook device 10 allows the user to suspend the personal item to prevent the item from being soiled or damaged on the floor. Further, hook device 10 minimizes the possibility that the item will be misplaced, forgotten, or perhaps stolen. Further, by using hook device 10, a woman may be less inclined to hold her purse in her lap, which is uncomfortable. Hook device 10 has a hook portion that is retractable into a substantially horizontal position such that the hook is substantially parallel with the flat table surface when not in use, and thus is not in the way when a person is seated at the table, bar, desk, or the like. The potentially undesirable consequences of hook devices of the prior art is therefore substantially reduced.

Figure 5:
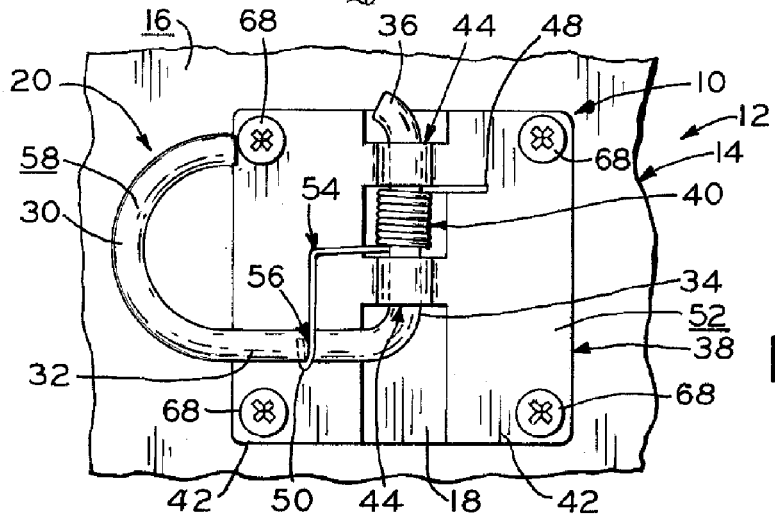
FIG. 5 is a bottom view of the table of FIG. 4 taken along line 5—5.

Referring to FIGS. 1, 2 and 5 hook device 10 is illustrated as being secured to a conventional table 12. Table 12 includes table top 14 having flat bottom surface 16 to which hook device 10 is secured. Hook device 10 includes substantially flat base 18 that is mounted in abutting relationship with flat table surface 16. Hook 20 is pivotally secured to base 18 by attachment mechanism 22 with hook 20 having a first, stored position (FIG. 2) and a second, operable position (FIG. 1).

Figure 4:
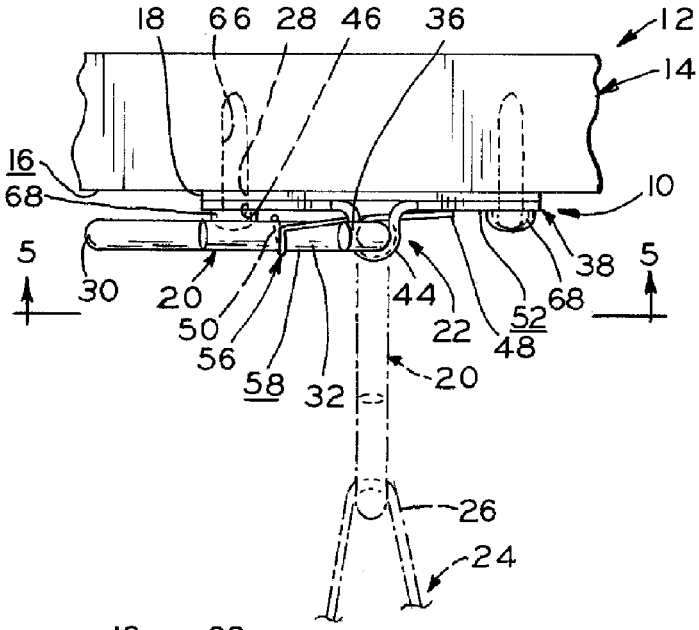
FIG. 4 is a side view of the table of FIG. 1 showing both the stored and operable positions of the hook.

Referring to FIG. 2, in the first, stored position, hook 20 of hook device 10 lies in a plane substantially parallel to that of flat table surface 16. Hook 20 is biased into the first position by attachment mechanism 22. When hook device 10 is in use, personal item 24, such as a purse having strap 26 (FIGS. 1 and 4), is suspended from hook 20. The user pivots hook 20 away from the bottom of surface 16 of table top 14 a distance that allows personal item 24 to be placed on hook 20. The weight of personal item 24 then pivots hook 20 to its substantially vertical, operable position (FIG. 4). In some instances, hook 20 may not reach a fully vertical position if the weight of the personal item is not able to completely overcome the bias of attachment mechanism 22.

Hook device 10 includes base 18, hook 20, and attachment mechanism 22. Base 18 is constructed from a material robust enough to withstand the loads applied thereto by a variety of personal items. The material may be steel, aluminum, or the like. Alternatively, the material may also be some types of plastic. Base 18 is formed by any suitable method including molding, or being cut from sheets of the chosen material. Base 18 is illustrated as being substantially square; however, base 18 may be any desired shape. Referring to FIG. 4, apertures 28 are formed at the corners of base 18 for receiving fasteners used to secure hook device 10 to table 12.

Referring to FIG. 5, hook 20 is substantially C-shaped with semicircular portion 30 designed to prevent personal item 24 from falling off of hook 20. Hook 20 also includes straight portions 32 and 34 which are substantially perpendicular to each other. Curved end portion 36 is defined at the free end of portion 34 to prevent the hook from being removed from attachment mechanism 22 as will be described further hereinbelow. Hook 20 may be formed from any suitable material able to withstand the weight of personal items 24. One such material may be a round steel bar stock which is bent into the desired shape, rounded to formed curved portion 36, and is provided with a smooth finish. Materials having a square, rectangular or other shape cross section may also be used. In some instances, hook 20 may also be coated with a material to alter the aesthetic appeal of the hook or allow the hook to be camouflaged beneath table top 14. The coating may also provide a smooth surface that is in contact with personal item 24.

Attachment mechanism 22 engages both base 18 and hook 20 to bias hook 20 into a first, stored position. Attachment mechanism 20 includes plate 38 and torsion spring 40. Plate 38 is constructed from the same material as base 18 and may be formed by any suitable method to have approximately the same outside dimensions as base 18. Plate 38 includes two rectangular portions 42 which are integrally connected by a pair of U-shaped members 44 (FIG. 4). Hook 20 is pivotably received in U-shaped members 44 and is confined between plate 38 and base 18 when the plate is mounted in abutting contact with the base. Apertures 46 (FIG. 4) are formed at the corners of plate 38 in locations that align with apertures 28 in base 18 when hook device 10 is assembled to receive fasteners for mounting the device.

Torsion spring 40 of attachment mechanism 22 is wrapped around a section of portion 34. The width of torsion spring 40 that is mounted on hook 20 is slightly less than the gap existing between U-shaped members 44 so that torsion spring 40 is captured between members 44 and does not slide along hook portion 34. In addition, the distance between curved portion 36 of hook 20 and the end of torsion spring 40 nearest curved portion 36 is approximately equal to the width of U-shaped member 44 which further prevents sliding of hook 20 relative to plate 38.

Referring to FIG. 5, torsion spring 40 has two ends 48 and 50 which act as lever arms to bias hook 20 into the first, stored position. First spring end 48 is in contact with outer surface 52 of plate 38. Second spring end 50 is formed having substantially 90 degree bend 54 that allows end 50 to be directed from hook portion 34 toward linear hook portion 32. At the end of second spring end 50 is hook 56 which engages outwardly facing surface 58 of hook portion 32. Second spring end 50 applies a spring force to outwardly facing surface 58 of hook 20 to bias hook 20 against plate 38.

The biasing force of torsion spring 40 is determined by the force required to maintain hook 20 in its first, stored position. The force is further defined by the average weight of the personal item 24 being placed on hook 20. For example, if hook device 10 is mounted on table 12 located in a restaurant, personal item 24 may most often be a purse. If hook device 10 is mounted on table 12 in a library, personal item 24 may most often be a backpack which would contain items that are heavier than those in a purse. Therefore, the tension in torsion spring 40 in hook device 10 can be less in the restaurant because the weight of the purse must overcame the biasing force of the spring to move hook 20 to a second position. If the tension in torsion spring 40 is too great, the purse will not move hook 20 from its stored position to the operable position.

Figure 3:
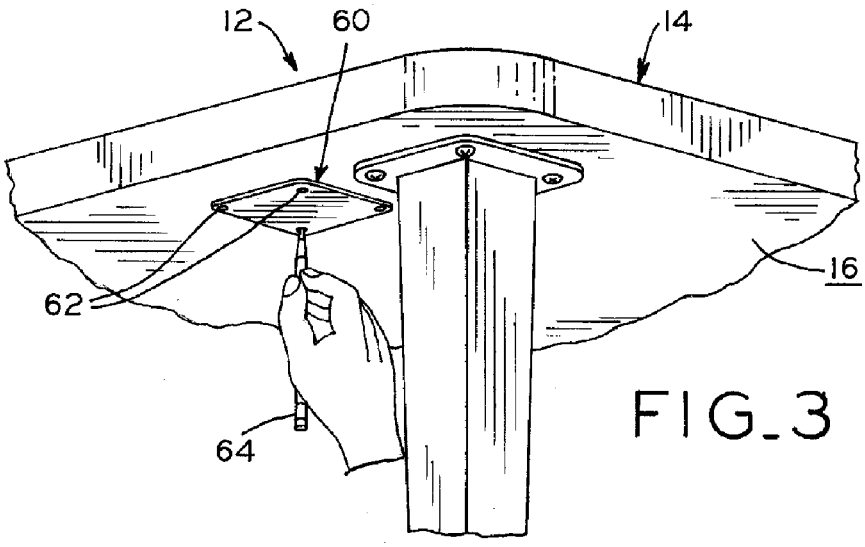
FIG. 3 is a fragmentary perspective view of the table of FIG. 1 illustrating mounting of the hook device in accordance with the present invention.

Referring to FIG. 3, hook device 10 also includes mounting template 60. Mounting template 60 is provided to ensure that holes pre-drilled into table 12 are in the proper locations when hook device 10 is secured to the table. Mounting template 60 is constructed from any suitable, disposable material such as cardboard, paper, plastic, or the like. Apertures 62 are formed in mounting template 60 in locations that coincide with apertures 28 and 46 in base 18 and plate 38 (FIGS. 3 and 4), respectively. Mounting template 60 is illustrated as being substantially the same dimensions as base 18; however, mounting template 60 may be any size as long as apertures 62 therein are in the appropriate locations to coincide with base apertures 28 and plate apertures 46. By sizing template 60 similarly to base 18, packaging hook device 10 may be less complicated.

In order to install hook device 10, mounting template 60 is placed against flat table surface 16 in the location where hook device 10 is to be mounted. A marking instrument 64 is used to mark table surface 16 at four corners which coincide with apertures 28 and 46 in base 18 and plate 38, respectively. Apertures 66 (FIG. 4) are drilled at the marked locations and hook device 10 is placed against table surface 16 so that base apertures 28 and plate apertures 46 are aligned with apertures 66 in table surface 16. Alternatively, apertures 66 may be drilled through apertures 62 in mounting template 60 rather than using marking instrument 64.

Hook device 10 is then assembled with torsion spring 40 being mounted to hook 20. Hook 20 and torsion spring 40 are then positioned relative to plate 38 with spring end 48 being positioned in contact with surface 52 of plate 38 and spring end 50 being attached to hook 20. Plate 38 is then placed in abutting contact with base 18 and aligned apertures 28 and 46 of hook device 10 are aligned with apertures 66 in table 12. Hook device 10 may be oriented with the opening of hook 20 facing any desired direction, i.e. toward or away from a person seated at table 12. Fasteners 68, such as screws, are then used to secure hook device 10 to table 12. Alternatively, adhesives that are able to withstand the suspended weight of a typical personal item may be used to secure hook device 10 to table 12. In most instances, the adhesive should be able to hold up to 50 pounds of suspended weight.

Figure 6:
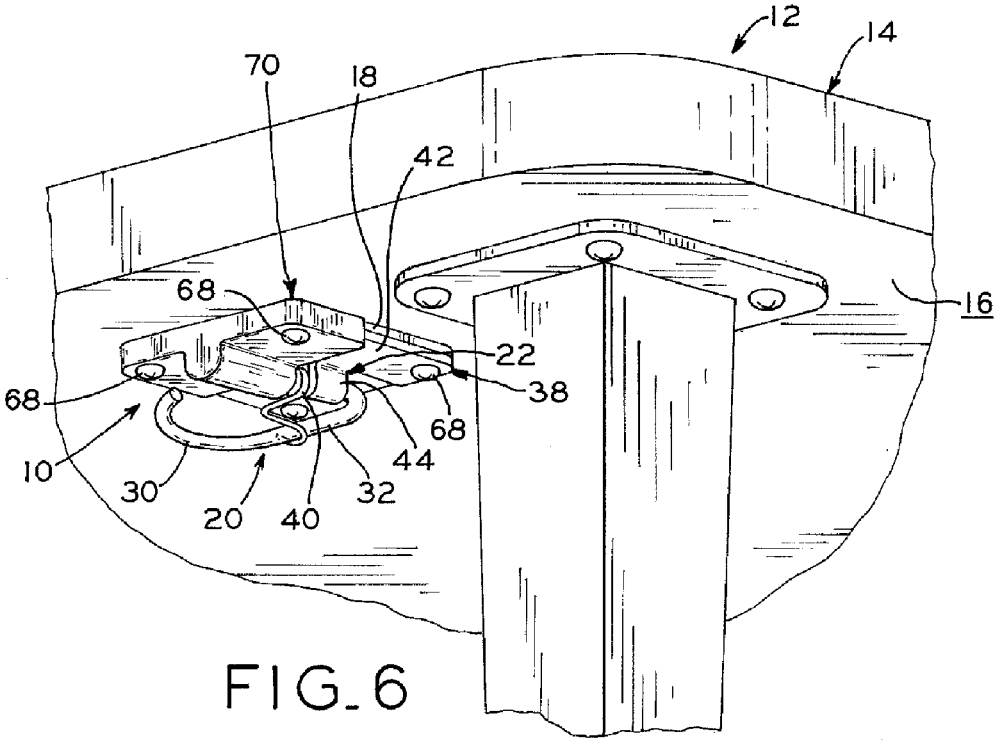
FIG. 6 is a perspective view of a table having an alternative embodiment of a hook device including a cover.
Figure 7:
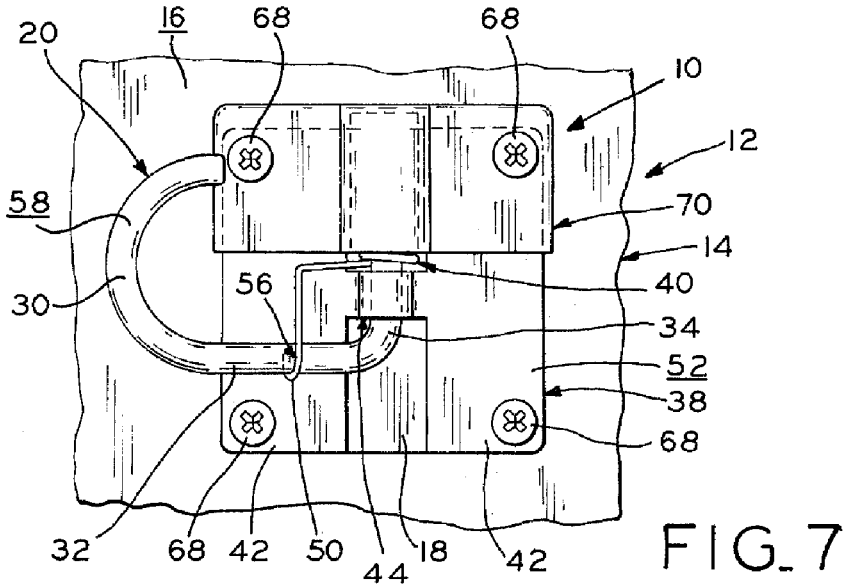
FIG. 7 is a bottom view of the table and hook device of FIG. 6.

In an alternative embodiment illustrated in FIGS. 6 and 7, hook device 10 may be provided with cover 70 to encase a portion of hook device 10 including a majority of torsion spring 40. Thus, cover 70 prevents a person seated at table 12 from contacting torsion spring 40 and snagging clothing, for example, while still permitting pivotal movement of hook 20. Cover 70 may be molded from a plastic material to mimic the general shape of base 18 and a portion of attachment mechanism 22 including spring 40 and one U-shaped member 44. Cover 70 is then mounted in position using two fasteners 68 used to mount hook device 10. Cover 70 may also be integral with plate 38.

While this invention has been described as having exemplary designs, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains.

What is claimed is:

1. A hook device for suspending personal items from a flat surface, said hook device comprising:

a substantially planar base adapted for attachment to said flat surface;

a hook pivotably mounted to said base whereby when said hook is in a stored position, said hook is substantially parallel to said base, said hook substantially confined to pivotal only movement with respect to said base: and an attachment mechanism pivotally mounting said hook to said base, said attachment mechanism including a plate and a spring, said spring mounted on said hook, said plate capturing said spring and preventing said spring from translational movement with respect to said hook, wherein said attachment mechanism plate includes a pair of U-shaped portions, said U-shaped portion defining a gap therebetween, said spring defining a width slightly less than said gap.

2. The hook device of claim 1, wherein said hook is captured between said attachment mechanism plate and said base.

3. The hook device of claim 1, wherein said hook has a flat planar profile disposed parallel to said planar base when said hook is in said stored position.

4. The hook device of claim 1, wherein said base is attached to said flat surface via a fastener selected from the group consisting of a plurality of screws and an adhesive material.

5. The hook device of claim 1, wherein said hook has a circular cross-sectional shape.

6. The hook device of claim 1, further comprising a template for mounting said hook device.

7. A hook device for suspending personal items from a flat surface, said hook device comprising:

a substantially planar base adapted for attachment to the flat surface;

a hook pivotably mounted to said base, whereby when said hook is in a stored position, said hook is substantially parallel to said base;

a spring associated with said hook, said spring maintaining said hook in said stored position;

an attachment mechanism including a plate and said spring, said plate capturing said spring and preventing said spring from translational movement with respect to said hook; and a cover covering at least a portion of said spring, wherein said attachment mechanism plate includes a pair of U-shaped portions, said U-shaped portions defining a gap therebetween, said spring defining a width slightly less than said gap.

8. The hook device of claim 7, wherein said attachment mechanism prevents translational movement of said hook relative to said base.

9. The hook device of claim 7, wherein said spring is mounted on said hook, said hook captured between said attachment mechanism plate and said base.

10. The hook device of claim 7, wherein said hook has a flat planar profile disposed parallel to said planar base when said hook is in said stored position.

11. The hook device of claim 7, further comprising a template for mounting said hook device.

12. The hook device of claim 7, wherein said hook has a circular cross-sectional shape.

13. A hook device for suspending personal items from a flat surface, said hook device comprising:

a substantially planar base adapted for attachment to the flat surface;

a hook pivotably mounted to said base, said hook having a substantially flat planar profile, whereby when said hook is in a stored position, said flat planar profile of said hook is substantially parallel to said base; and an attachment mechanism securing said hook to said base, said attachment mechanism including a plate and a spring, said plate substantially preventing translational movement of said hook relative to said base, wherein said attachment mechanism further comprises a pair of U-shaped portions connected to said plate, said U-shaped portions defining a gap therebetween, said defining a width slightly less than said gap.

14. The hook device of claim 13, wherein said spring is mounted on said hook.

15. The hook device of claim 13, wherein said hook has a circular cross-sectional shape.

16. The hook device of claim 13, further comprising a cover mounted to said base for covering at least a portion of said attachment mechanism.

17. The hook device of claim 13, further comprising a template for mounting said hook device.

* * * * *